US007967619B2

(12) United States Patent
Dianqing et al.

(10) Patent No.: US 7,967,619 B2
(45) Date of Patent: Jun. 28, 2011

(54) LIGHT STRING WITH IMPROVED SHUNT SYSTEM

(76) Inventors: Zheng Dianqing, Guangdong (CN); Qi Chen, Guangdong (CN)

( * ) Notice: Subject to any disclaimer, the term of this patent is extended or adjusted under 35 U.S.C. 154(b) by 0 days.

(21) Appl. No.: 12/384,005

(22) Filed: Mar. 31, 2009

(65) Prior Publication Data

US 2009/0317996 A1 Dec. 24, 2009

Related U.S. Application Data

(63) Continuation-in-part of application No. 11/977,621, filed on Oct. 25, 2007, now Pat. No. 7,591,658.

(60) Provisional application No. 61/072,458, filed on Mar. 31, 2008.

(30) Foreign Application Priority Data

Oct. 25, 2006 (CN) ..... 2006 2 0015418
Aug. 18, 2008 (CN) ..... 2008 2 0146495

(51) Int. Cl.
*H01R 29/00* (2006.01)

(52) U.S. Cl. ..... 439/188

(58) Field of Classification Search ..... 439/375, 439/699.2, 188, 189; 200/51.1; 362/288, 362/655

See application file for complete search history.

(56) References Cited

U.S. PATENT DOCUMENTS 932,139 A 8/1909 Kempton
1,536,332 A 5/1925 Dam
2,984,813 A 5/1961 Bossi
3,286,088 A 11/1966 Ahroni
3,522,579 A 8/1970 Matsuya
4,720,272 A 1/1988 Durand
5,139,343 A 8/1992 Lin
5,281,158 A 1/1994 Lin
5,453,664 A 9/1995 Harris (Continued)

FOREIGN PATENT DOCUMENTS

CN 2253524 Y * 4/1997

*Primary Examiner* — Javaid Nasri
(74) *Attorney, Agent, or Firm* — Brian K. Johnson, Esq. LLC

(57) ABSTRACT

This utility model relates to a decorative light, and particularly, to a decorative light capable of avoiding an open circuit condition on an entire string of bulbs that operate in series when an individual bulb is removed. The decorative light comprises a socket, a bulb base, a bulb and two terminals, wherein the socket is provided with a retainer therein, which has an opening laterally extending therethrough, and an elastic, conductive ring or coil with a thickness smaller than a width of the opening is disposed within the opening. When the elastic ring or coil is in a natural state, the elastic ring extends outside the retainer through the opening at two sides of the retainer. The bulb base is further provided with an inserting partition at the bottom thereof The elastic conductive ring has two states: one is a separating state where the bulb base is inserted into the socket. In this first state, the inserting partition of the bulb base separates one side of the elastic ring or coil from the corresponding terminals. The other state is a conducting state of the two terminals when the bulb base is removed from the socket. In this second state both sides of the elastic, conductive ring or coil provide contact with the two terminals respectively. This utility model provides a decorative light capable of preventing failure of the complete string of bulbs when any bulb is removed.

5 Claims, 6 Drawing Sheets

U.S. PATENT DOCUMENTS

| | | | | |
|---|---|---|---|---|
| 5,791,940 | A | 8/1998 | Chen et al. | |
| 5,807,134 | A | 9/1998 | Hara | |
| 5,816,862 | A | 10/1998 | Tseng | |
| 5,839,819 | A | 11/1998 | Pan | |
| 5,860,830 | A | 1/1999 | Wu | |
| 6,257,740 | B1 | 7/2001 | Gibboney, Jr. | |
| 6,533,437 | B1 | 3/2003 | Ahroni | |
| 6,783,383 | B1 | 8/2004 | Gibboney | |
| 6,929,383 | B1 | 8/2005 | Janning | |
| 7,264,392 | B2 * | 9/2007 | Massabki et al. | 362/652 |
| 7,581,870 | B2 * | 9/2009 | Massabki et al. | 362/654 |
| 2007/0297196 | A1 * | 12/2007 | Massabki et al. | 362/655 |

* cited by examiner

LIGHT STRING WITH IMPROVED SHUNT SYSTEM

CROSS-REFERENCES TO RELATED APPLICATIONS

This application claims priority under 35 USC §119 from U.S. Provisional Patent Application No. 61/072,458, filed Mar. 31, 2008 and having the title LIGHT STRING, the disclosure and application of which is incorporated by reference herein in its entirety.

This application also claims priority under 35 USC §120 as a continuation-in-part from U.S. patent application Ser. No. 11/977,621, filed Oct. 25, 2007 now U.S. Pat. No. 7,591,658 and having the title LIGHT STRING WITH IMPROVED SHUNT SYSTEM, which in turn claims priority under 35 USC §119 from Chinese patent application Serial. No. 200620015418.0, filed on Oct. 25, 2006, entitled DECORATIVE LIGHT, all the disclosures and applications of which are incorporated by reference herein in their entirety.

This application is further related to U.S. patent application Ser. No. 12/383,934, filed Mar. 30, 2009 and having the title LIGHT STRING WITH IMPROVED SHUNT SYSTEM, which in turn claims priority under 35 USC §119 from Chinese patent application Ser. No. 200820146495.9 filed on Aug. 18, 2008, entitled A DECORATIVE LIGHT, all the disclosures and applications of which are incorporated by reference herein in their entirety.

TECHNICAL FIELD

This utility model relates to a decorative light, and particularly a decorative light capable of avoiding an open circuit condition on an entire string of bulbs that operate in series when an individual bulb is removed.

TECHNICAL BACKGROUND

In the prior holiday lights, a number of small low-voltage bulbs connected in series are lit up simultaneously. Due to the serial connection, a blown fuse or the removal of one or more of the bulbs will interrupt the complete series circuit connection. To solve this problem, China Patent CN2253524Y discloses a bulb with a resistance wire that can complete the circuit when the bulb's tungsten filament is fused, so as not to affect normal operation of other bulbs. However, according to the technology disclosed in the China Patent CN2253524Y, the resistance wire or fuse is disposed within the bulb, so when one bulb in a decorative light string consisting of such bulbs comes off, an open circuit will still occur, causing the entire string of bulbs to go out.

SUMMARY OF THE INVENTION

One object of this utility model is to overcome the aforesaid drawbacks of the prior art by providing a decorative light capable of preventing failure of the complete string of bulbs when an individual bulb is removed or bums out.

Another object of this utility model is to provide a decorative light that is easy to assemble.

A third object of this utility model is to provide a decorative light that ensures reliable conductive connection by having a conductive device in a socket make full contact with the terminals when a bulb comes off The objects of this utility model can be achieved by the following solutions:

In one particularly preferred embodiment of the present invention, a light holder is made for providing electrical connection between two light string terminals, the light holder comprising: a retainer having a housing volume; an electrically conductive, deformable, multi-looped coil is disposed within the housing volume of the retainer, the multi-looped coil has two loop distensions, the loop distensions are in electrical contact with respective the terminals when no light bulb is inserted into the light holder, at least one of the loop distensions are deformed so as to break the electrical contact with its respective the terminal when a light is inserted into the light holder such that the electrical connection between the terminals takes place through the bulb.

In another aspect of this embodiment, the light holder retainer includes guide lips to seat the multi-looped coil within the housing volume of the retainer.

In another particularly preferred embodiment of the present invention, a light holder is made providing electrical connection between two light string terminals; the light holder comprising: a socket having a retainer, the retainer having a housing volume; an electrically conductive, deformable, multi-looped coil disposed within the housing volume of the retainer; the multi-looped coil having two loop distensions, one of the loop distensions being in contact with one of the light string terminals; the other of the loop distensions being in contact with the other of the light string terminals when no light bulb is present in the holder so as to electrically connect the two light string terminals through the coil; the loop distension being displaced and disengaged from the respective light string terminal when a light bulb is present in the holder so as to electrically connect the two light string terminals through the light bulb.

In another aspect of this embodiment, the light holder comprises a bulb base containing the light bulb, the bulb base includes an inserting partition, the distensions of the coil are capable of being displaced in a plurality of locations by the inserting portion so as to disengage from the other of the light string terminals when the bulb base containing the light bulb is present in the holder.

As compared to the prior art, when an individual bulb is removed from the bulb base in the decorative light of this utility model, the elastic conductive coil can complete the circuit connection reasonably immediately due to the expansion of the ring so as not to affect operation of the whole string of bulbs. The elastic conductive coil may be pre-mounted into the retainer and then the retainer incorporating the elastic conductive coil as a whole is fitted into the socket. Therefore, the decorative light of this invention has a feature that it is easy to assemble. In case the bulb base and the bulb come off from the socket, the elastic conductive ring will make contact with the terminals at both sides. Moreover, the decorative light of this invention features reliable conductive connection without false contact and arcing. Because decorative lights are often moved by the wind or moved around by the user, this feature makes the decorative light safer for use.

DETAILED DESCRIPTION OF THE INVENTION

Figure 1:
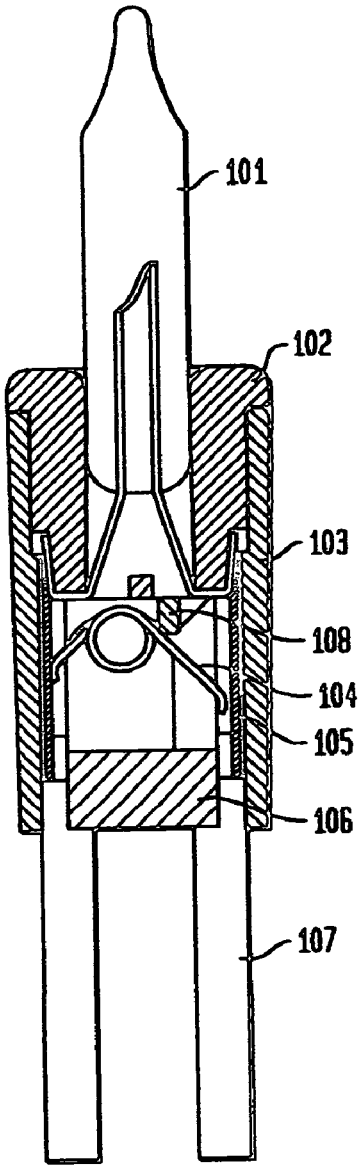
FIG. 1 is an assembly diagram according to a first embodiment of the present invention.
Figure 2:
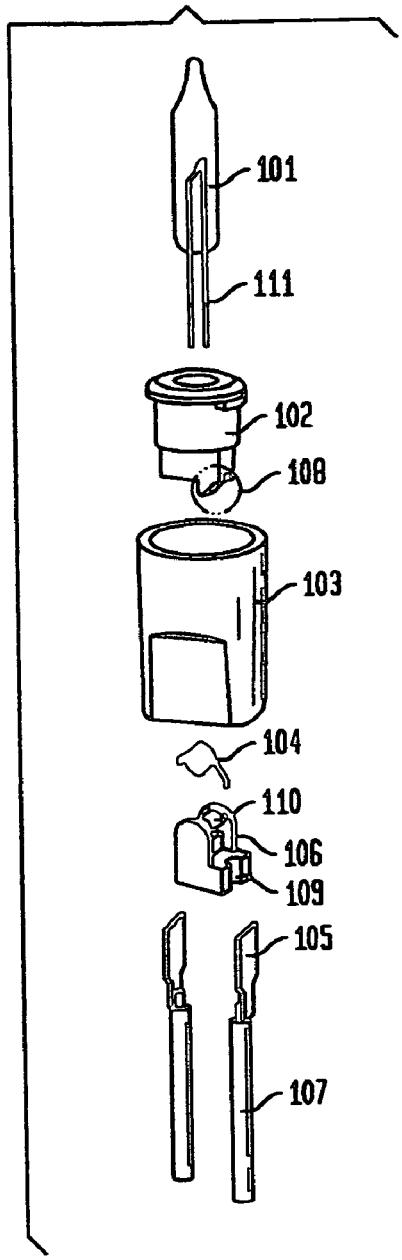
FIG. 2 is a disassembly diagram according to a first embodiment of the present invention.
Figure 3:
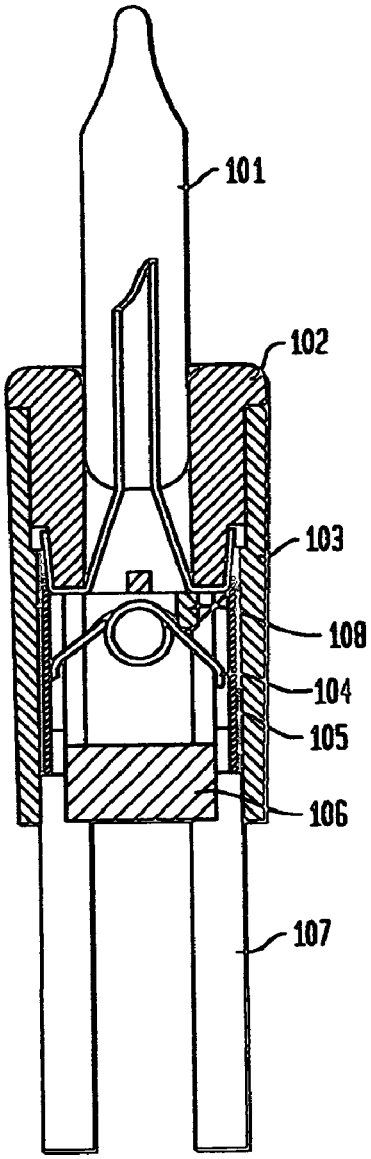
FIG. 3 is another assembly diagram according to a first embodiment of the present invention.
Figure 4:
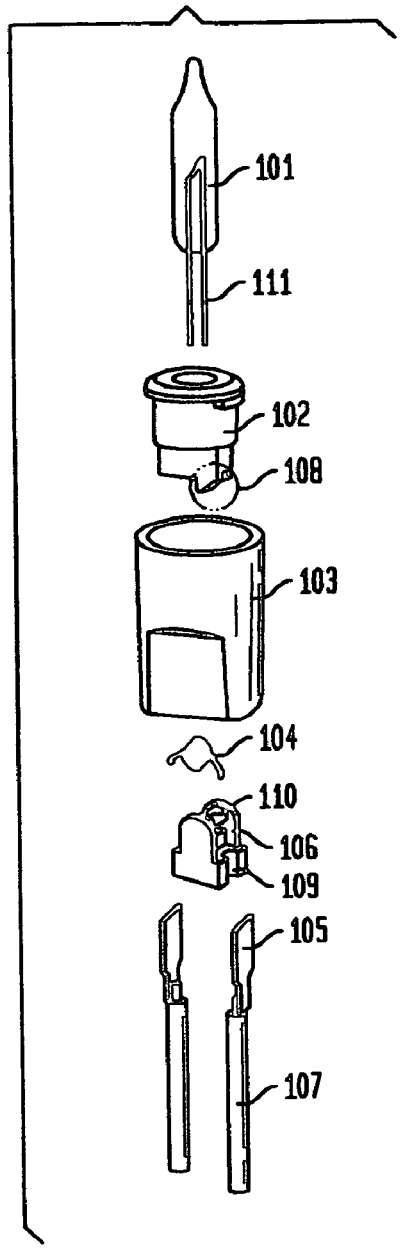
FIG. 4 is another disassembly diagram according to a first embodiment of the present invention.

Hereinafter, this utility model will be further described with reference to the drawings. FIGS. 1-4 show a first embodiment of the present utility model. Bulb 101 and lamp base 102 are preassembled together, and then an assembled body of the bulb 101 and the lamp base 102 is inserted into one end of the lamp holder 103. The copper terminals 105 are pressed into the ends of the wires 107; there are two wires 107 as well as two copper terminals 105 provided; the copper terminals 105 are inserted in the other end of the lamp holder 103. As shown in FIG. 1, the two copper terminals 105 are respectively connected to the two electrodes 111 of bulb 101. There is a bulge 108 at the end of the lamp base 102 facing to the copper terminals 105. The bulge is close to one of the two terminals 105. A torsion spring 104 made with steel wire is arranged in the lamp holder 103. The torsion spring 104 is provided with two feet corresponding to the positions of the copper terminals 105, one foot is in contact with one of the terminals 105, and the other foot is spaced apart from the other of the terminals 105 due to the presence of the bulge 108 on the lamp base. The two feet of the torsion spring are respectively connected to their corresponding terminals to establish a circuit by means of the torsion force from the torsion spring when the assembled body of the lamp base 102 and the bulb 101 is removed from the lamp holder 103. The torsion spring 104 of the present utility model has a cylindrical shape with wound steel wire, and has a hollow passage. An end plug or retainer 106 containing a recessed volume 109 is provided in the lamp holder 103 and the end plug or retainer is arranged between the two terminals 105. A post 110 is set at the end plug or retainer 106 and the post is fitted into the hollow passage of the cylindrical-shaped torsion spring 104. The torsion spring 104 makes the circuit connected by means of a torsion force when one or several assembled bulbs and the lamp bases fall off.

The decorative light of the present utility model is generally used with a plurality of decorative lights connected in series to form a string light. In order to avoid a power short circuit caused by the removal of all light bulbs from the string light, at least one light of the string light should not be the decorative light of the present embodiment. Alternatively, a decorative light with a fuse can be used or a decorative light of the present embodiment can be used in the string light after a torsion spring is removed.

Figure 5:
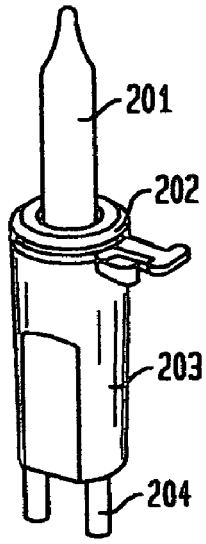
FIG. 5 is an assembly diagram according to a second embodiment of the present invention.
Figure 6:
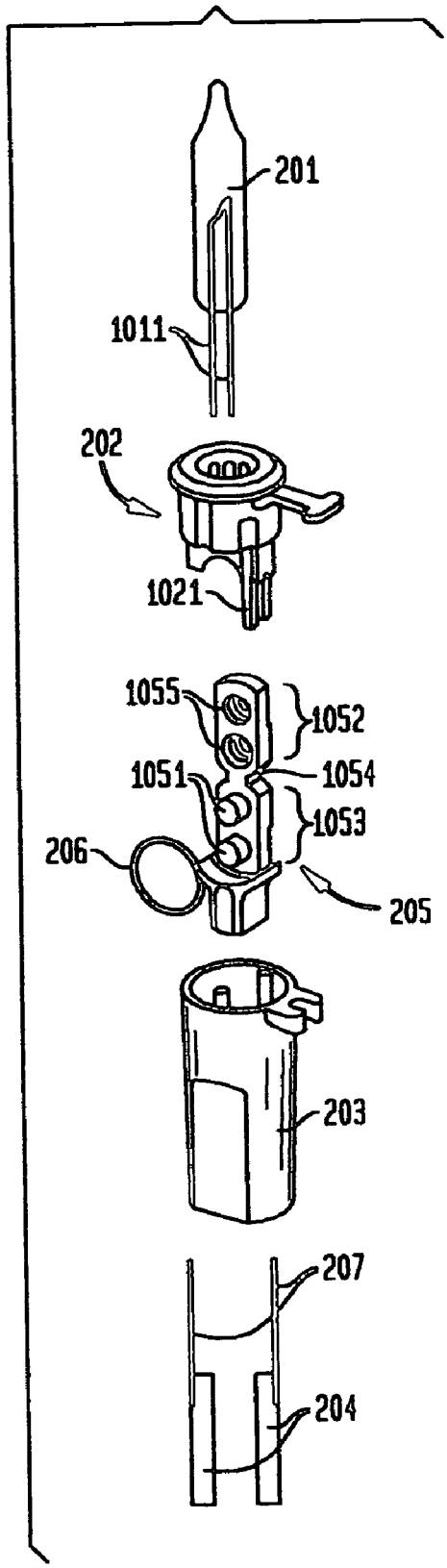
FIG. 6 is a disassembly diagram according to a second embodiment of the present invention.

Referring to FIGS. 5 and 6, a second embodiment of the present invention is a decorative light comprising a socket 203, a bulb base 202, a bulb 201 and two terminals 207. The bulb 201 is disposed on the bulb base 202, with two electrodes 1011 of the bulb 201 passing through the bulb base 202 to form two contacts at the bottom of the bulb base 202. The socket 203 is shaped like a barrel, the bulb base 202 is inserted into the top end of the bulb base 203, and the two terminals 207 are inserted to the bottom end of the socket, with the two electrodes at the bottom of the bulb base 202 contacting against the two terminals 207 respectively. The terminals 207 are pressed to corresponding power leads 204. The socket 203 is further provided with a retainer 205 therein, which has an opening laterally extending therethrough and an elastic, conductive ring 206 disposed within the opening. A thickness of the elastic, conductive ring 206 is smaller than a width of the opening so that the elastic conductive ring 206 can move laterally within the opening. When the elastic ring 206 is in a natural state, the elastic conductive ring 206 extends outside the retainer 205 through the opening at both sides of the retainer 305 respectively. The bulb base 202 is further provided with an inserting partition 1021 at the bottom thereof The elastic conductive ring 206 has two states: the first is a separating state where the bulb base 202 is inserted into the socket 203, in which state the inserting partition 1021 of the bulb base 202 separates and electrically disconnects one side of the elastic ring 206 from a corresponding terminal 207. The second state is a conducting state of the two terminals 207 when the bulb base 202 is removed from the socket 203 (i.e. the light bulb is removed), in which state both sides of the elastic conductive ring 206 contact against the two terminals 207 respectively. An upper and a lower protrusion 1051 for limiting vertical movement of the elastic, conductive ring are provided inside of the opening of the retainer 205. The elastic conductive ring 206, when assembled, encircles the two protrusions 1051 so as to limit vertical movement of the elastic conductive ring 206 by means of the two protrusions 1051. The elastic conductive ring 206 is allowed to make a slight movement in the lateral direction to provide for elasticity. On the bottom of the opening of the retainer 205 is an arc-shaped surface corresponding to an outer circular perimeter of the elastic conductive ring 206, so as to render the elastic conductive ring 206 more stable within the retainer and easy to be assembled. In this embodiment, the retainer 205 is an assembled part that is divided into two detachable portions by the opening, and the two portions are joined by an elastic plastic piece at the top of the opening so that, with the elastic plastic piece as a hinge, the two portions can be separated from each other to a certain extent at the opposite side, thereby allowing assembly of the elastic conductive ring 206. To clarify, the opening is formed between sections 1052 and 1053 when section 1052 of retainer 205 is bent down at hinge 1054 such that protrusions 1051 insert into holes 1055. When the bulb base 202 and the bulb 201 are assembled, the inserting partition 1021 of the bulb base is inserted through between the side of the elastic conductive ring 206 and the terminals 207, and the elastic conductive ring 206 is shaped into an elliptical form. In this arrangement the two terminals 207 are not connected to each other via the elastic, conductive ring 206 and power is supplied to bulb 201 through electrodes 1011. However, when the bulb base 202 and the bulb 201 are removed from the socket 203, the elastic conductive ring 206 will substantially restore the circular form under action of its elasticity. To ensure a contact pressure between the elastic conductive ring 206 and the two terminals 207, the elastic conductive ring 206 is slightly deformed. In this arrangement, the elastic conductive ring 206 contacts against both the two terminals 207 to connect them together and provide electrical coupling therebetween.

The present utility model provides a decorative light which keeps working when one or several assembled light bulbs and lamp bases are removed.

Certain improvements have been made to the two light string designs to provide additional functionality, replacement ease, versatility, and manufacturability. With respect to the first embodiment, experience showed that some bulbs had difficulty lighting for a variety of reasons. Primarily among these were that the short side of torsion spring 104 was too short and released its electrical connection with terminal 105. As a corrective measure to this, the torsion spring may be constructed of equal length or substantially equal length sides. This design change may be accompanied by other form factor changes such as: a more ovular-shaped socket to accommodate the substantially equal-length legs, a centering of the post 110 within end plug or retainer 106; and bi-directional construction of the lamp base 102 such that the blub base may be inserted into the socket in more than one orientation. In addition other electrical design changes may be made to solve inconsistencies in the lighting of the bulbs. For example, the lengthening the torsion springs leg length and widening the surface of the legs that make contact with the terminals leads to provide more reliable electrical connections being made and broken. Also the material qualities of the spring may be changed, e.g. from a #55 carbon steel to a #65 carbon steel, to increase the spring constant of the piece thereby providing faster and more certain electrical connections. Several of these changes are illustrated in the designs shown in FIGS. 1-6.

Figure 7A:
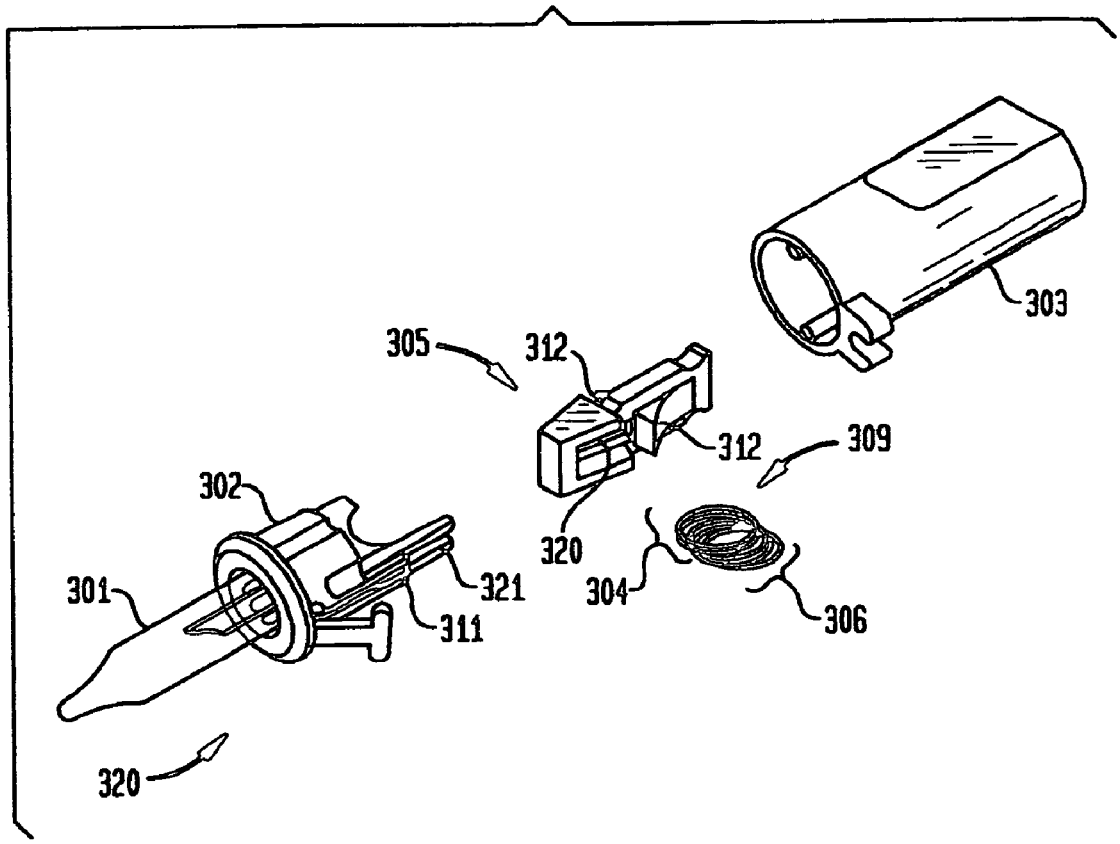
FIGS. 7A, B & C are assembly views of an alternative to the second embodiment of the present invention.
Figure 7B:
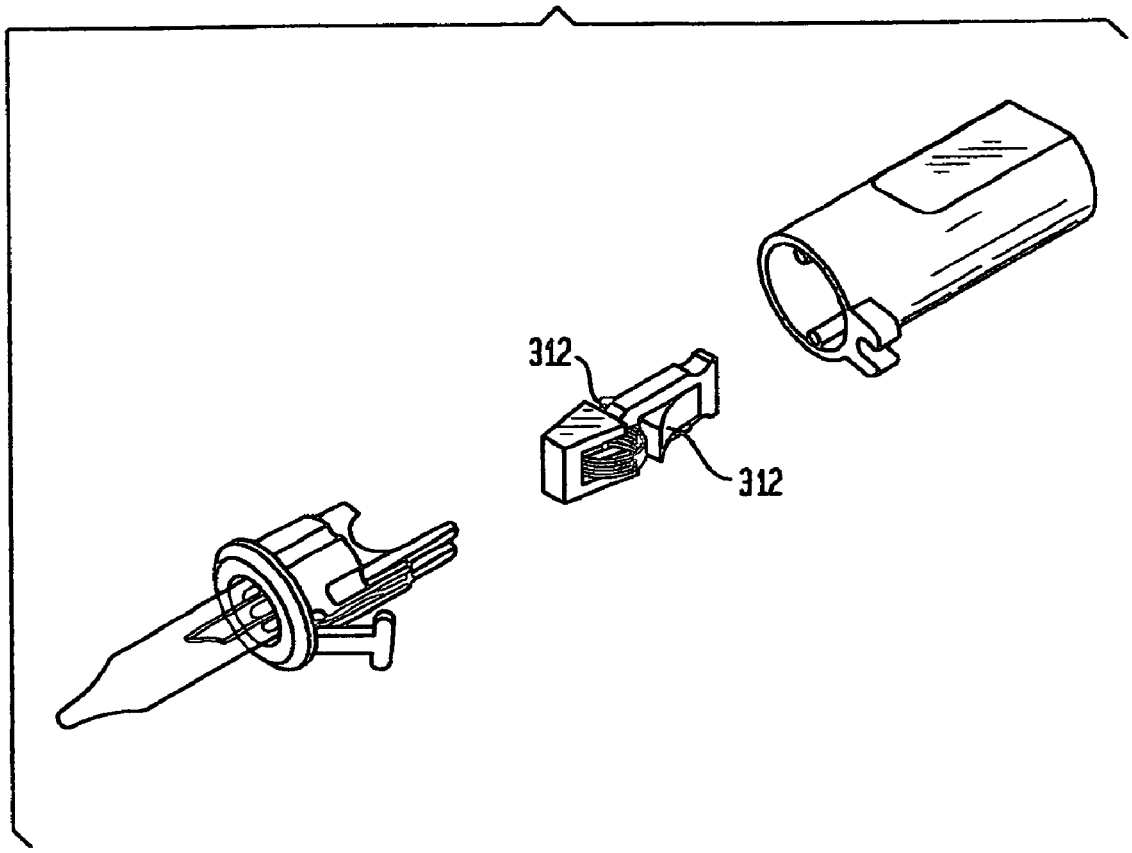
Figure 7C:
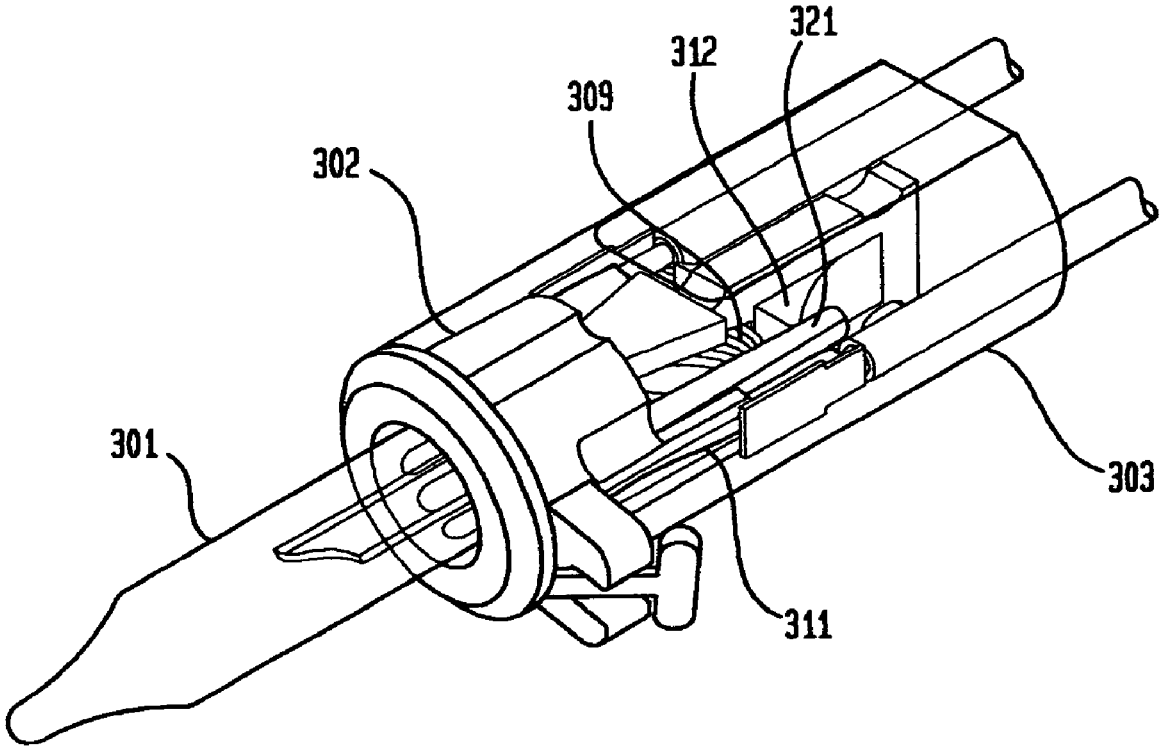

With respect to the second embodiment, designs other than a single loop elastic ring 206 may be conceived that leverage the advantages of both the elastic ring and the tension spring. FIGS. 7A and 7B show such a design in which the single-loop elastic ring and fold-over retainer 205 are replaced with a multi-looped coil 309 and non-foldable retainer 305. Multi-looped coil 309 has two elastic distensions of the loops 304 and 306 that lie outside of the coil's cylindrical profile. The multi-loop coil can then be easily inserted into coil housing volume 320 within retainer 305 for easier assembly than that required of the fold-over assembly 205. Once inserted, the retainer may be easily inserted into socket 303 such that without the bulb 301 inserted therein, the two elastic distensions of the loops 304 and 306 make electrical contact with terminals 307 within socket 305 (not shown). Lips 312 on retainer 305 provide support for the bottom of the two elastic distensions of the loops 304 and 306 so as to maintain their orientation upon insertion of the fully-assembled retainer into the socket shown in FIG. 7B.

With respect to the operation of this second embodiment alternative, the inserting partition 321 of bulb base 302 acts to push one or the other of the two elastic distensions of the loops 304 and 306 so as to break electrical connection between the terminals 305 through the multi-looped coil 306 and force the electrical connection of the terminals 305 through the bulb 301 via its leads 311.

Those of skill in the art will recognize additional variations in the design of the light string embodiments contained herein without departing from the nature of the invention disclosed.

What is claimed is:

1. A light holder for providing electrical connection between two light string terminals, said light holder comprising:

a retainer having a housing volume;

an electrically conductive, deformable, multi-looped coil disposed within said housing volume of said retainer, said multi-looped coil having a hollow passage, at least one coil of said multi-loop coil distended such that said hollow passage of said at least one distended coil is not in alignment with said hollow passage of said remaining coils of said multi-looped coil, said at least one distended coil and said multi-looped coil being in electrical contact with respective said terminals when no light bulb is inserted into said light holder, either one of said at least one distended coil or said multi-looped coil being displaced so as to break said electrical contact with its respective said terminal when a light is inserted into said light holder such that the electrical connection between the terminals takes place through said bulb.

2. The light holder of claim 1 wherein said retainer includes guide lips to seat said multi-looped coil within said housing volume of said retainer.

3. The light holder of claim 1 further comprising a bulb base containing said light bulb, said bulb base including an inserting partition, either said distended loop coils or said multi-looped coil being capable of being displaced by said inserting portion so as to disengage from said contacted light string terminals when said bulb base containing said light bulb is present in said holder such that said bulb may be inserted in said light holder in a plurality of orientations.

4. A light holder for providing electrical connection between two light string terminals; said light holder comprising:

a socket having a retainer, said retainer having a housing volume;

an electrically conductive, deformable, multi-looped coil disposed within said housing volume of said retainer; said multi-looped coil having a hollow passage; at least two coils of said multi-looped coil being distended such that said hollow passages of said two coils are not in alignment with either said hollow passage of said remaining coils of said multi-looped coil or each other, one of said distended loop coils being in contact with one of said light string terminals and the other of said distended loop coils being in contact with the other of said light string terminals when no light bulb is present in said holder so as to electrically connect the two light string terminals through said coil; at least one of said distended loop coils being displaced and disengaged from said respective light string terminal when a light bulb is present in said holder so as to electrically connect the two light string terminals through said light bulb.

5. The light holder of claim 4 further comprising a bulb base containing said light bulb, said bulb base including an inserting partition, either of said distended loop coils being capable of being displaced by said inserting portion so as to disengage from said contacted light string terminals when said bulb base containing said light bulb is present in said holder such that said bulb may be inserted in said light holder in a plurality of orientations.

* * * * *